United States Patent [19]

Panach et al.

[11] Patent Number: 5,020,196

[45] Date of Patent: Jun. 4, 1991

[54] NINETY DEGREE TURN FASTENER

[76] Inventors: Rafael B. Panach; Rafael B. Royo, both of Poeta Artola 15., 46021 Valencia, Spain

[21] Appl. No.: 486,373

[22] Filed: Feb. 28, 1990

[51] Int. Cl.[5] ..... A41F 1/00

[52] U.S. Cl. ..... 24/590; 24/98

[58] Field of Search ..... 24/590, 113 MP, 98, 24/453; 411/553, 549

[56] References Cited

U.S. PATENT DOCUMENTS

| | | | |
|---|---|---|---|
| 157,883 | 12/1874 | Spruce | 24/590 |
| 665,985 | 1/1901 | White et al. | 24/98 |
| 676,810 | 6/1901 | Young | 24/590 |
| 718,018 | 1/1903 | Northrop | 24/590 |
| 782,460 | 2/1905 | Northrop | 24/590 |
| 810,537 | 1/1906 | Hopkins | 24/590 |
| 944,673 | 12/1909 | Harrison | 24/590 |
| 1,148,444 | 7/1915 | Crawford | 24/590 |
| 3,743,147 | 7/1973 | Wilezynski | 24/590 |

FOREIGN PATENT DOCUMENTS

| | | | |
|---|---|---|---|
| 61400 | 9/1912 | Switzerland | 24/590 |

*Primary Examiner*—Victor N. Sakran

*Attorney, Agent, or Firm*—Wolf, Greenfield & Sacks

[57] ABSTRACT

The present invention relates to a ninety degree turn fastener composed of two parts made of resistant materials, either metal or other, which meet the technical requirements to allow their machining in order that they may fulfill their purpose; once the parts have been machined and by the nature of the functions they perform within the fastener, we shall call them females and male, with the same outline shapes to ensure that they match; the face of the female part in its central area is made up of a raised flat surface with a concave rear side to accommodate the wings of the male part, this being surrounded by another dish-shaped plane, which constitutes the base for attachment of the fastener; the center of the front face has a rectangular opening, with a width appropriate for carrying out its purpose, and approximately three times as long as it is wide. The outer attachment plate has a groove with several holes distributed along it, and a number of clamps for attachment, whether it be by sewing or by any other means; the male part is flat on its rear side; from the center of the face there protrudes a round nucleous measuring the same as the width of the opening in the female part, which opening matches the central nucleous ended in a T shape, whose wings are sufficiently separated from the base plate as to clear the side faces of the female opening when turning through 90 degrees in order to fasten; the length is equal to that of the female opening; the means of attachment of the male part to its corresponding piece of garment are the same as the means of attachment of the female part to its corresponding piece.

12 Claims, 2 Drawing Sheets

11
12
13
13
14
15
16
17

NINETY DEGREE TURN FASTENER

The present invention is concerned with providing a new special fastener to the clothing and other similar industries, with the object of fastening together pieces of textile or other kinds of material which, due to their industrialization and for their use, have to be fastened and unfastened, in order to accomplish their function, as is the case with garments for normal wear and others, providing greater convenience and effectiveness to the user in its operation: summing up, a new procedure, with its corresponding industrialization device in order to achieve said aim.

It is a known fact that the manufacturing industry for clothes and other similar products uses different fastening systems, in order to fasten the different parts which make up this wider range of garments: currently the most widely used devices are the well known buttonhole, with fastening by means of a button, the clasp hook, made up of a hook and an eye, the stud press, the zip, and others, the above being the most commonly used.

Of all the above, the most widely used system is the buttonhole, fastened by means of a button; when this system is used, a cut is made in the material to open a buttonhole in the garment, making as many buttonholes as buttons it is intended to sew on, in order to button up the garment, in order to button up the garment involved, be it a jacket, shirt, dress of any kind or other items; this system has serious drawbacks, namely the need to make a cut in the garment, which is irreversible in case one should want to modify the positions of the buttonholes which have already made, as well as causing deformation of the buttonholes with use, and tearing of the material originated by the cut made for the buttonhole.

The system using a hook clasp, seldom used, must be conceived in cases where the fastening is to be held under tension, otherwise it will become undone, causing the relevant parts of the garment to separate; it is therefore not used in loosely worn garments, due to the foregoing drawback.

Another system is the press stud, widely used throughout the clothing industry and for other general uses, but it has the disadvantage that it becomes undone by applying a little force, separating the parts which it is intended to join, and it is also susceptible of premature deterioration.

We also observe deficiencies as regards the zip system, as we shall see later on in a comparison between this system and that of the invention, since the zip has the disadvantage of opening only at one end, there being no possibility of opening it at intermediate points of its path, so it cannot be used to fasten a stationary point, which leads us to conclude that its use is limited.

Such a state of technology as described above is susceptible of improvement, as regards the need to provide the clothing and related industries with a new fastening device, such as that of the invention, facilitating its development for the function fastening together different parts of a garment by the aforesaid methods, the industrial and economic advantages are many and quite evident: there is no need for buttonholes or cuts in order to fasten; the speed of the fastening operation; the minimal cost of fitting it; effectiveness and safety; it takes up less space; it is easy to change; long life; the possibility of sewing or clamping without damaging the materials, easy to use by the user.

The invention solves the aforesaid technical problems by using the fastener which is the object of the present patent application, for its industrial manufacture and commercialization.

The main object of the invention is, therefore, to provide a new type of fastener, made of metal or of other similar materials, for its application to the clothing industry and for general use, in order to eliminate said deficiencies. Another aim of the invention is to provide a fastener which can be fitted attaching it to the garment or item of clothing, or for other fastening uses as required by the user, making it operative for other generic purposes.

Another aim of the invention is a wide level of application of same, for any thickness of garment to be fastened, without any flattening, and without any need for cuts in the garment materials.

Another aim of the invention is to enable the fastener to be moved to another position, without any damage to the or the fitting elements, it requires less space since it is small in size, and very solid in relation to the effort it is subjected to.

Another aim of the invention is its safety and the simplicity with which it performs the function we are referring to, namely to fasten two parts of a garment and release them quickly, without any effort, and without the possibility of release unless wilfully acted on by the user.

Another secodary aim of the invention is, given the fitting system to be used in the manufacture of the elements of the system covered by the present invention, that said system can be concealed so that, in case of wanting to affix buttons or other ornaments, these can be fitted without any need for buttonholes, it being ideal for fastening loosely fitting garments as its accidental release is impossible.

Another secondary aim of the invention is that every fastener is independent of the rest, it being therefore possible to undo any of the middle ones, supposing that there be several arranged in a line, and it may also be used singly, as in shirt cuffs or in various dresses which only need one fastener.

Another secondary aim of the invention is that in order to unfasten it an operation involving movement is required, which cannot be performed without the user noticing it, thus allowing the user to detect any unwanted manipulation in case someone wants to unfasten de device against the user's wish.

The attainment of all these aims, as well as others which will become evident at the end of the present description, is achieved, in accordance with the present invention, by the industrial provision of two pieces of resistant material, which can be metal or a similar material, which pieces must have a variable shape but an adequate thickness, must be flat, and have the same profile in order that they match; one of the pieces we shall call the female part by reason of its function, and the other the male part, also in view of the function it is to perform; the female part is, in its dentral area, formed by a raised, disc shaped plane, which has in its centre an opening of rectangular shape, with a length approximately three times its width, leaving a margin around its edges to provide space for a number of holes and clamps, in order to attach these parts of the fastener to the relevant garment, whether it be by sewing, clamping, or attached by other means; the male part has in its central area a round nucleus of the same width as the opening in the female part, ending in a rectangular T-shaped figure, forming two wings, so that it passes through the opening in the female part when confronted face to face, the wings parallel to the face will leave enough space to clear the thickness of the material in the opening; the male part is provided with the same attachment devices as the female.

These two machined parts constitute the basic elements of the NINETY DEGREE TURN FASTENER, which is the object of the invention, the operation of which takes place in the stages: one part of the fastener will be attached to either side of the garment we want to do up, with the opening on the female at right angles to the nucleus on the male; in order to fasten the two elements together we must turn around 90 degrees the part of the garment with the male piece relative to the garment facing it, making the two parts of the fastener fit in a rectangular position, inserting the male nucleus into the female opening, bringing both faces into close contact, then turning around ninety degrees, and returning the garment to its previous position, thus fastening the two garments as required, which will remain with the two parts of the fastener having their opposite faces in close contact, held in position by the wings of the male part, which has been so designed so as to prevent said wings to slip through the lateral sides of the female opening; the male part being held firmly in position once the 90 degree turn has been carried out, but free to move along the groove in the female part, so as to prevent it form rubbing against the material inside the female plate; in order to unfasten, repeat the same procedure in opposite sense, turning the garments through 90 degrees around the axis of the male so as to coincide with the female opening, separating both garments, which will now be free. The advantages derived through this invention are: a cinsiderable reduction in time, by attaching the fasteners to clothing and similar items, producing garments which require strong fastening devices, without any need for buttonholes or cuts in the material; providing the clothing industry and similar industries with a fastener with the above stated improvements, reducing the manufacturing costs; the possibility of changing the fasteners from any position to another when required without any damage to the fastener or to the material; the convenience for the user due to the simplicity of the fastening and unfastening procedures, which can be performed in the shortest possible time.

It can be envisaged to plan the manufacture of this NINETY DEGREE TURN FASTENER for large production series, in different models and measurements, numbering the sizes for each series, creating different model varieties for application to each particular case; in view of and with due appreciation of this invention, k there is an obvious opportunity for the birth of an industry with great industrial potential, in order to supply all the complex ramifications of this wide sector or clothes manufacturing; summing up, and with due appreciation of the industrial utility of the modernization of the clothing and similar industries, providing it with said fastener, which eliminates the problems presented by products using current technology.

As an aid to the understanding of this invention, describe in the present report, two sheets of drawings a ta a variable scale are attached, for information purposes, and purely as an example, in which:

The drawings in sheet 1 are represented such that they comprises six figures.

Figure 3:
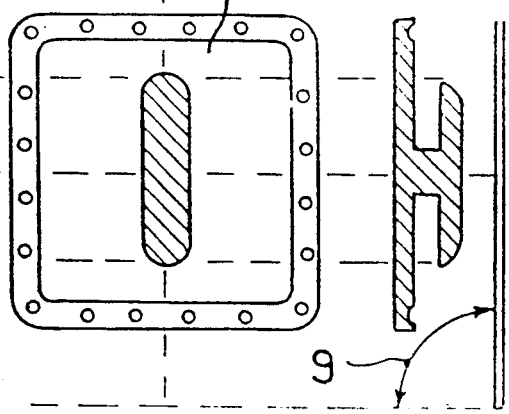

FIG. 3 details the position of the male part after the ninety degree turn, front view of the flat face, elevated view from above and elevated view from the right.

Figure 4:
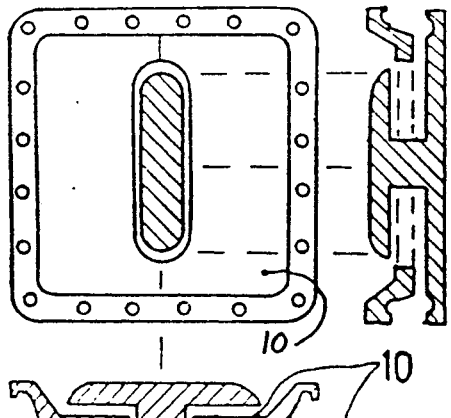

FIG. 4 represents the rear side of the flat female part, at the time of fitting the male nucleus, elevated cross-sectional view form above and elevated cross section from the right.

Figure 5:
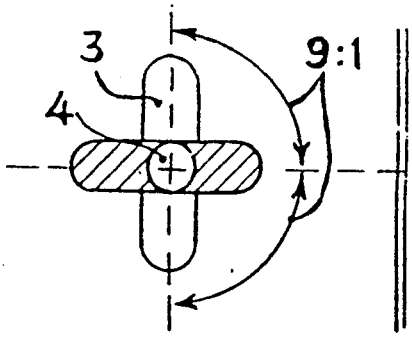

FIG. 5 is a drawing representing the 90 degree turn of the male and female axes, irrespectively to the right or to the left, in order to perform the fastening or unfastening operation.

Figure 6:
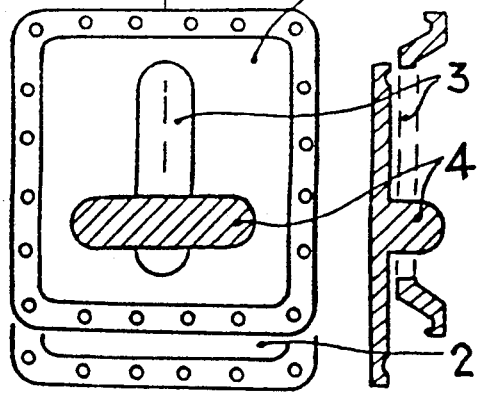

FIG. 6 provides a view of the parts making the fastener in the fastened position, seen from the rear of the female part, and with their faces joined together, elevated view from above and cross section from the right. The drawing in sheet two comprises two figures, number 7 and number 8, giving a description of two pieces of material to be fastened by means of the fastener system.

Figures 7, 8:
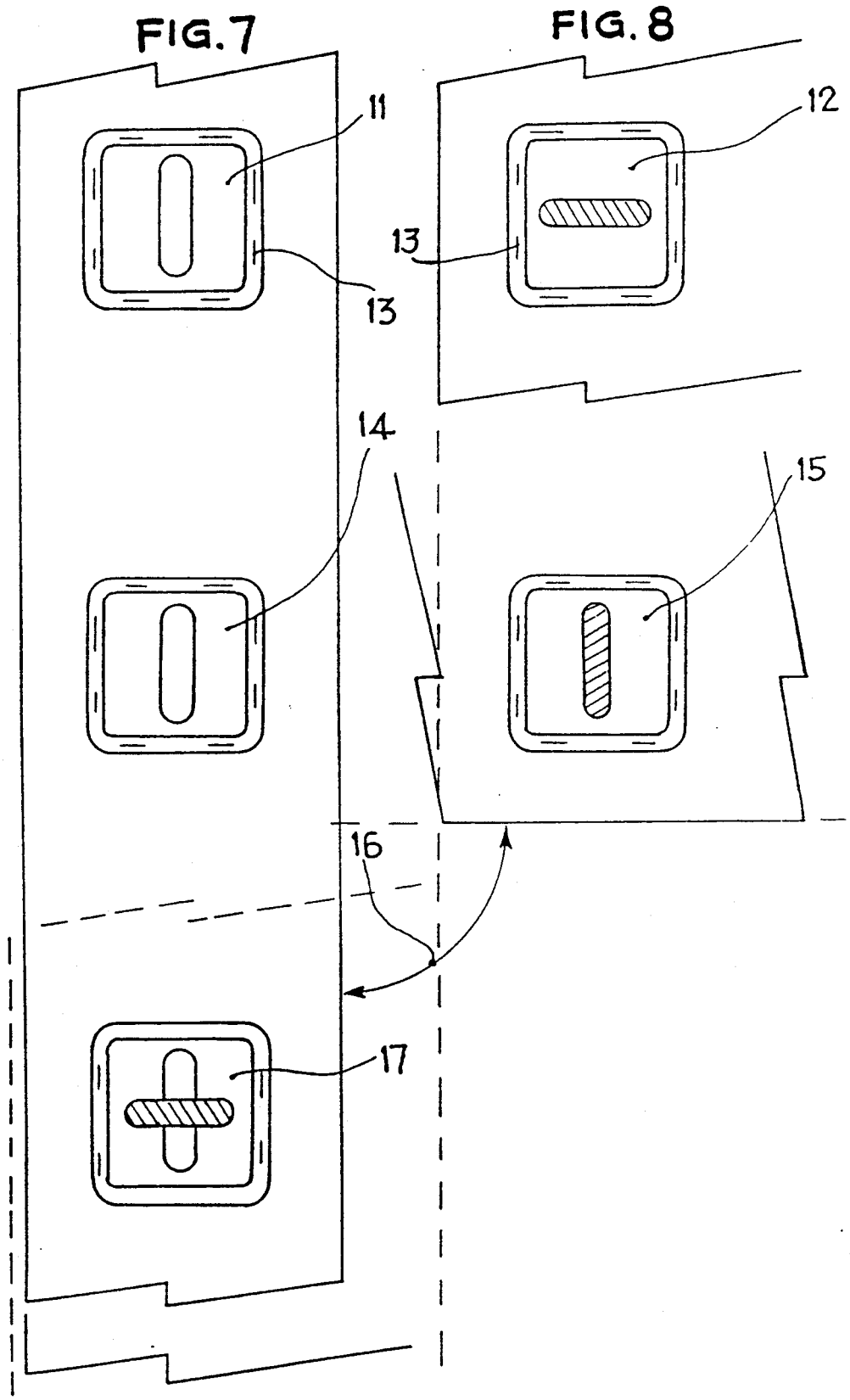

FIG. 7 represents three female fastener parts attached, their openings in a vertical line and in the correct position, to the inner side of the piece to which they are sewn or clamped, so that they are hidden from view; the drawings are intended to provide a better understanding of the stages of fastening of both pieces.

FIG. 8 represents the second piece of material to be joined by the fastener, with the male parts of the fastener attached to it, seen from the front, and with the central nucleus and wings in a horizontal position, which is the correct position for attaching them; the drawing illustrate the different movement positions in order to achieve fastening, which will be hidden by the lapel of the piece in FIG. 7.

The various parts of the fastener device represented as an example in said drawings are labelled as follows:

1. Face of the female side of the fastener.
1:1. Sides of the female opening.
2. Face of the male part of the fastener.
2:1. Separation between one face and the other, from the male to the nucleus.
3. Rectangular opening in the female part.
4. Round nucleus ended in a rectangular T shape with wings, of the male part, in horizontal position.
5. Space on the rear of the female part, to accommodate the wings of the male part.
6. groove to accommodate the attachment stitching and protect same.
7. Clamps for attaching fastener, which is done by bending them.
8. Holes for the attachment stitching.
9. Turning movement through ninety degrees for the fastening and unfastening operation.
10. Rear side of the female part in the shape of a dish in order to accommodate the nucleus and wings of the male.
11. Position and alignment of the openings of the female parts affixed in a vertical arrangement.

12. Attachment position of the male part with the nucleus and wings horizontal.
13. Attachment positions of the fastener parts in order to affix them to the material.
14. concave space of the female part to accommodate the wings of the male part.
15. Ninety degree turn of the piece of material, with the male in horizontal position, in order to join and fasten them.
16. Indication of the ninety degree angel of reverse turn of the part in order to achieve fastening.
17. Illustration after the ninety degree turn in the fastened position, and lodging of the male wings in the female cavity.

Figure 1:
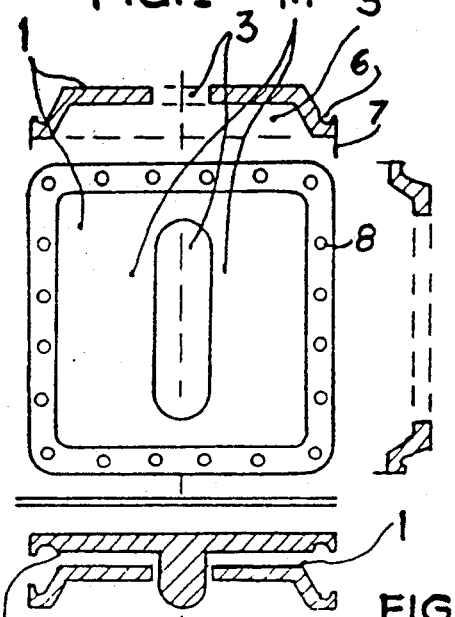
FIG. 1 represents the female part of the fastener in a front view of the flat face, an elevated cross section form above and an elevated cross-sectional view from the right.
Figure 2:
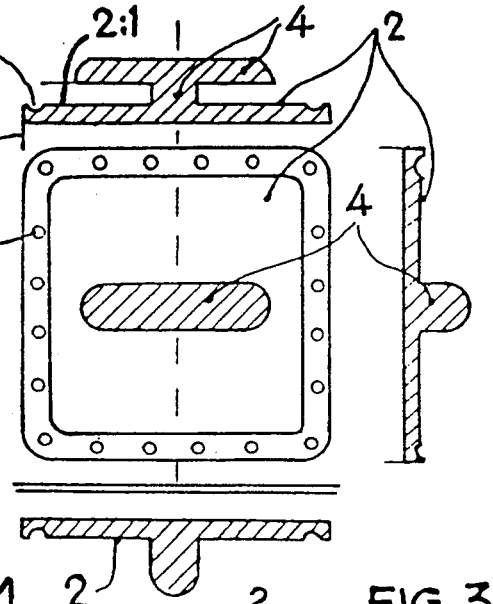
FIG. 2 represents the male part of the fastener in a front view of the flat face, an elevated cross-sectional view form above and an elevated cross-sectional view from the right.

From the various parts of the fastener, represented by way of an example in the above mentioned drawings in sheets 1 and 2, it easily be deduced that it is a simple, practical, effective and resistant fastener, with attachment and fastening and unfastening operations as follows; In drawing sheet no. 2, FIG. 7 and FIG. 8 represent two pieces of material to be fastened together using the fastener system. FIG. 7 illustrates three FIG. 1 parts, the female parts of the fastener, these are attached to one of the parts of the piece-garment to be fastened, following the order shown with -3-, rectangular opening, -6-, groove for the stitching, -8- stitching holes, -11- position of the rectangular openings in a vertical position, -13- attachment points following a vertical line, on the inner side of the piece-garment. The drawings are meant as an aid to understanding; FIG. 8 illustrates the mounting of 3 FIG. 2 parts, the male of the fastener, on the side of the piece-garment which it is required to fasten to the other, with three movement positions to facilitate fastening, according to the indications given -4- male rectangular nucleus in horizontal position, -6- groove for the protection of stitching, -8- opening for the attachment stitches, -12- positioning and attaching male to the piece-garment, with nucleus and wings in vertical position, -13- attachment points of male to the material; FIG. 3 and -15- ninety degree turn illustration,, -9- of the piece garment with the male in vertical position, to confront it with the female, join them and fasten them -14- and FIG. 4, male and female face to face, according to illustrations -1-, and sides of female -1:1-and -2:1- separation between male face and face of male nucleus and -2- faces of female and male, -3- female rectangular opening, -4- male with round nucleus and wings in T shape, -10- rear side of female, coupling of male; illustration, -16- 90 degree reverse turn of the piece-garment placing the swings of the male behind the sides of the female opening, crosswise position; and -17- returning to the correct position of the piece-garment; thus fastening both pieces, which remain held together by the fastener; which is illustrated by FIG. 6 by means of the indications -2-, -3-, and -10-; FIG. 5 shows the ninety degree turning movement -9:1- in order to fasten and unfasten, making sure that the male coincides with the female opening, separating the pieces-garments, which are now free, each with its fastener part.

Having adequately described the nature of the invention in the foregoing text, as well as the means of advantageously putting it to practice and showing that it constitutes a positive improvement both on technical and economic counts for the fastener manufacturing industry, it is hereby expressly stated that the arrangements indicated above are subject to modifications provided that the fundamental principle remains the same, which is what constitutes the essence of the invention under reference, as specified in the following:

We claim:

1. NINETY DEGREE TURN FASTENER comprising male and female parts made of resistant materials, said females and male parts having the same outline shapes to ensure that they match; the face of the female part in its central area is made up of a raised flat surface with a concave rear side to accommodate the wings of the male part, this being surrounded by another dish-shaped plane, which constitutes the base for attachment of the fastener; the centre of the front face has a rectangular opening, with a width appropriate for carrying out its purpose, and substantially three times as long as it is wide, the outer attachment plate has a groove with several holes distributed along it, and a number of clamps for attachment, whether it be by sewing or by any other means; the male part is flat on its rear side; from the centre of the face there protrudes a round nucleus measuring the same as the width of the opening in the female part, which opening matches the central nucleus ended in a T shape, whose wings are sufficiently separted from the base plate as to clear the side faces of the female opening when turning through 90 degrees in order to fasten; the length is equal to that of the female opening; the means of attachment of the male part to its corresponding piece of garment are the same as the means of attachment of the female part to its corresponding piece.

2. NINETY DEGREE TURN FASTENER as per claim 1, characterized by the fitting and attachment of the female and male parts to the garments or to other more general uses, which is carried out as follows: The parts which are to be fastened are affixed, facing each other, with the female opening at right angles to the nucleus and to the T-wings of the male; to fasten, turn the garment through ninety degrees, confronting the male and female parts in a rectangular position, inserting the male into the female opening; a ninety degree turn is performed again, returning the garment to its normal state, passing the wings of the male nucleus behind the side faces of the female opening, which is thus held in position; this ninety degree turn procedure produces the fastening of the pieces we wanted to hold together; unfastening is achieved by repeating the turning procedure in the opposite direction, thus releasing the two parts.

3. NINETY DEGREE TURN FASTENER as per claim 2, characterized by the simplicity of the fastening procedure and by the freedom of movement of the central nucleus of the male part along the female opening, held in its position by the wings, which slide behind the lateral faces; this longitudinal, although not frontal movement, is significant, since it prevents rubbing against the material inside the concavity of the female part, thus providing some moving space and leeway without unfastening.

4. NINETY DEGREE TURN FASTENER as per any of claims 1 to 3, characterized by the fact that the constituent parts of said fastener, combined and applied jointly, make up said fastener, in accordance with the following points:

(a) female part, which, in combination with the male part, makes up the fastener assembly.
(b) when attaching to the garments position the female and male parts at right angles, face to face, the female opening confronting the nucleus and rectangular wings of the male part.

(c) perform a 90 degree turn of the garments, thus confronting male and female parts in the right alignment.

(d) insert the nucleus and the wings of the male into the bottom of the female opening, assuring face to face contact.

(e) perform a 90 degree turn of both items which are now fastened by the fastener, this being the object of the invention.

5. NINETY DEGREE TURN FASTENER as per claim 4, characterized by the fact that it combines the material elements of the fastener, suitably attached to the garments or items to be joined together; making use of the 90 degree turn of the garments or items, face to face, to align the two parts of the fastener, and a 90 degree turn to return to their normal state the garments or items involved, thus producing the fastening and joining them together.

6. A fabric fastener comprising:

male and female members, each having means for attachment to said fabric, said male member comprising a planar base having a T-shaped projection extending perpendicularly thereform, said T-shaped projection having an elongated head coupled to said planar base by a cylindrical neck, said female member comprising a planar base having an elongated slot extending therethrough, said T-shaped projection is receivable within said slot so that said cylindrical neck slides freely therein allowing said male member planar base and said female member planar base to slide relative to one another.

7. The fastener of claim 6 wherein said cylindrical neck has a diameter which is substantially similar to the width of said elongated slot.

8. The fastener of claim 7 wherein the width of said elongated slot is such that said elongated head is retained therein.

9. The fastener of claim 8 wherein said female member further comprises an oblique wall projecting downward along the perimeter of said female member planar base.

10. The fastener of claim 6 wherein said means for attachment to said fabric comprises a plurality of apertures extending through male member base plate and said female member base plate to enable coupling to said fabric.

11. The fastener of claim 6 wherein said male member and said female member are formed of a rigid material.

12. The fastener of claim 6 wherein the length to width ratio of said elongated slot of said female member is approximately 3:1.

* * * * *